US012004569B2

(12) United States Patent
Kim et al.

(10) Patent No.: US 12,004,569 B2
(45) Date of Patent: Jun. 11, 2024

(54) AEROSOL GENERATING APPARATUS DETERMINING ABNORMAL OPERATION

(71) Applicant: KT&G CORPORATION, Daejeon (KR)

(72) Inventors: Yong Hwan Kim, Gyeonggi-do (KR); Sung Wook Yoon, Gyeonggi-do (KR); Seung Won Lee, Gyeonggi-do (KR); Dae Nam Han, Seoul (KR)

(73) Assignee: KT&G CORPORATION, Daejeon (KR)

( * ) Notice: Subject to any disclaimer, the term of this patent is extended or adjusted under 35 U.S.C. 154(b) by 693 days.

(21) Appl. No.: 17/267,284

(22) PCT Filed: Dec. 10, 2020

(86) PCT No.: PCT/KR2020/018105
§ 371 (c)(1),
(2) Date: Feb. 9, 2021

(87) PCT Pub. No.: WO2021/182724
PCT Pub. Date: Sep. 16, 2021

(65) Prior Publication Data

US 2022/0408830 A1 Dec. 29, 2022

(30) Foreign Application Priority Data

Mar. 13, 2020 (KR) ..... 10-2020-0031310

(51) Int. Cl.
*A24F 40/50* (2020.01)
*A24F 40/46* (2020.01)
*A24F 40/65* (2020.01)

(52) U.S. Cl.
CPC ..... *A24F 40/50* (2020.01); *A24F 40/46* (2020.01); *A24F 40/65* (2020.01)

(58) Field of Classification Search
CPC ..... A24F 40/46; A24F 40/65; A24F 40/50
(Continued)

(56) References Cited

U.S. PATENT DOCUMENTS 10,182,597 B2 * 1/2019 Schiff ..... A24F 40/44
10,869,974 B2 * 12/2020 Akao ..... A61M 15/06
(Continued)

FOREIGN PATENT DOCUMENTS

CN 109644524 A 4/2019
CN 110213972 A 9/2019
(Continued)

OTHER PUBLICATIONS

Extended European Search Report dated Nov. 19, 2021, issued by the European Patent Office in application No. 20870443.7.
(Continued)

*Primary Examiner* — Abdullah A Riyami
*Assistant Examiner* — Vladimir Imas
(74) *Attorney, Agent, or Firm* — Sughrue Mion, PLLC

(57) ABSTRACT

According to some embodiments, an aerosol generating device may include a battery, a first control circuit configured to convert power received from the battery into a pulse width modulation (PWM) signal, a heater configured to heat an aerosol generating article based on the PWM signal received from the first control circuit, and a second control circuit configured to transmit an instruction for causing the first control circuit to generate the PWM signal, in response to a user input to the first control circuit. The first control circuit may determine abnormal operation of the second control circuit, and the second control circuit may determine abnormal operation of the aerosol generating device. Accordingly, the aerosol generating device may determine a more specific operation state and prevent abnormal operation of the heater.

10 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 11,450,901 | B2 * | 9/2022 | Akao | A24F 40/90 |
| 2002/0058493 | A1 | 5/2002 | Ikeda et al. | |
| 2016/0050974 | A1 | 2/2016 | Galloway et al. | |
| 2017/0251725 | A1 | 9/2017 | Buchberger et al. | |
| 2017/0303595 | A1 | 10/2017 | Bernauer et al. | |
| 2018/0132531 | A1 | 5/2018 | Sur et al. | |
| 2019/0208822 | A1 | 7/2019 | Mullin | |
| 2020/0046025 | A1 | 2/2020 | Otiaba et al. | |
| 2020/0093185 | A1 | 3/2020 | Lim | |
| 2020/0108213 | A1 * | 4/2020 | Akao | G01R 31/392 |
| 2020/0212517 | A1 * | 7/2020 | Akao | A24F 40/53 |
| 2020/0260791 | A1 * | 8/2020 | Lee | A24F 40/51 |
| 2021/0007404 | A1 * | 1/2021 | Lee | A24F 40/53 |
| 2021/0052835 | A1 * | 2/2021 | Lee | H05B 1/02 |
| 2021/0069434 | A1 * | 3/2021 | Akao | H02J 7/0063 |
| 2021/0195961 | A1 * | 7/2021 | Marubashi | A24F 40/50 |
| 2022/0117042 | A1 | 4/2022 | Mullin | |
| 2022/0160045 | A1 * | 5/2022 | Horrod | A24F 40/51 |
| 2022/0225680 | A1 * | 7/2022 | Lopez | A24D 1/20 |
| 2022/0225681 | A1 * | 7/2022 | White | A24D 1/20 |
| 2022/0240585 | A1 * | 8/2022 | Horrod | H02M 7/4815 |

FOREIGN PATENT DOCUMENTS

| | | | |
|---|---|---|---|
| JP | 2009-97836 | A | 5/2009 |
| KR | 10-2002-0037713 | A | 5/2002 |
| KR | 10-1570876 | B1 | 11/2015 |
| KR | 10-2018-0129637 | A | 12/2018 |
| KR | 10-2019-0003842 | A | 1/2019 |
| KR | 10-2019-0035486 | A | 4/2019 |
| KR | 10-2020-0004692 | A | 1/2020 |
| WO | 2018/037207 | A1 | 3/2018 |
| WO | 2018/134564 | A1 | 7/2018 |
| WO | 2019/156382 | A1 | 8/2019 |
| WO | 2020/017789 | A1 | 1/2020 |

OTHER PUBLICATIONS

International Search Report dated Mar. 24, 2021 from the International Searching Authority in International Application No. PCT/KR2020/018105.

Office Action dated Jul. 2, 2023, in Korean Application No. 10-2022-0082476.

Office Action dated May 8, 2023, in Chinese Application No. 202080005775.1.

Office Action issued Nov. 15, 2023 in Korean Application No. 10-2022-0082476.

* cited by examiner

AEROSOL GENERATING APPARATUS DETERMINING ABNORMAL OPERATION

CROSS REFERENCE TO RELATED APPLICATIONS

This application is a National Stage of International Application No. PCT/KR2020/018105, filed Dec. 10, 2020, claiming priority to Korean Patent Application No. 10-2020-0031310, filed Mar. 13, 2020.

TECHNICAL FIELD

Embodiments of the present disclosure relate to an aerosol generating device for determining abnormal operation.

BACKGROUND ART

Recently, the demand for alternative methods to overcome the shortcomings of general cigarettes has increased. For example, there is an increasing demand for a system that generates an aerosol by heating cigarettes or an aerosol generating material using an aerosol generating device, rather than by combusting cigarettes.

In an aerosol generating device, a heater is used to heat the aerosol generating material. When the heater malfunctions, the user's smoking satisfaction decreases, and an accident such as a fire may occur. Accordingly, in order to increase the stability of the aerosol generating device, there is a need for a technique for preventing malfunctions by determining an abnormal state of the aerosol generating device.

DISCLOSURE OF INVENTION

Technical Problem

When an abnormal heating operation is performed due to abnormal operation of an aerosol generating device, hardware components inside the aerosol generating device may be damaged or a safety problem may occur. However, when an error occurs in a control circuit that controls the aerosol generating device, it may be difficult to determine abnormal operation of the aerosol generating device or prevent an abnormal heating operation.

Solution to Problem

Various embodiments of the present disclosure may provide an aerosol generating device for determining abnormal operation as a method of solving the above-described problems. Additional aspects will be set forth in part in the description which follows and, in part, will be apparent from the description, or may be learned by practice of the presented embodiments.

As a technical means for achieving the above-described technical problems, an aerosol generating device according to an aspect includes: a battery; a first control circuit configured to convert power received from the battery into a PWM signal; a heater configured to heat an aerosol generating article based on the PWM signal received from the first control circuit; and a second control circuit configured to transmit an instruction for causing the first control circuit to generate the PWM signal in response to a user input to the first control circuit, wherein, based on the first control circuit determining that the second control circuit is operating abnormally, the first control circuit may block the PWM signal transmitted to the heater.

Advantageous Effects of Invention

Embodiments of the present disclosure may provide an aerosol generating device. In more detail, a first control circuit of the aerosol generating device according to the present disclosure may be provided and, when the first control circuit does not receive a parameter generated from a second control circuit within a preset time, or parameters generated from the second control circuit and the first control circuit do not match each other, may determine abnormal operation of the second control circuit and block a PWM signal transmitted from the first control circuit to a heater.

As such, when it is determined that the second control circuit is operating abnormally, the aerosol generating device according to an embodiment of the present disclosure may prevent abnormal heating due to a continuous heating operation of the heater by blocking the PWM signal transmitted from the first control circuit to the heater.

The first control circuit may heat the heater by receiving a control command to start a heating operation of the heater from the second control circuit. However, when the first control circuit does not receive a control command to terminate the heating operation of the heater from the second control circuit within a preset time and continues heating, a safety problem may occur.

When the parameters generated from the second control circuit and the first control circuit do not match each other, it may not be clear which of the second control circuit and the first control circuit is operating abnormally. It is safer for the first control circuit to determine abnormal operation of the second control circuit and terminate the heating operation rather than continuing the heating operation according to the parameter generated from the second control circuit. Accordingly, the first control circuit may be used as an additional safety device in addition to a direct safety device, user convenience may be increased, accidents such as fire may be prevented, and user anxiety may be relieved.

Further, the second control circuit of the aerosol generating device according to an embodiment of the present disclosure may determine abnormal operation of the aerosol generating device based on at least one from among a parameter generated from the first control circuit, a parameter generated from the second control circuit, and a parameter indicating whether power is supplied to at least one from among the first control circuit and the second control circuit.

The second control circuit may determine abnormal operation of any number of components and functions included in the aerosol generating device, such as power of the aerosol generating device, the first control circuit, and communication. Accordingly, abnormal operation of the aerosol generating device may be determined in more detail.

As described above, because the second control circuit and the first control circuit included in the aerosol generating device according to an embodiment of the present disclosure may determine each other's state based on parameters exchanged with each other through communication, abnormal operation of any one of the second control circuit and the first control circuit may be determined.

BEST MODE FOR CARRYING OUT THE INVENTION

Figure 1:
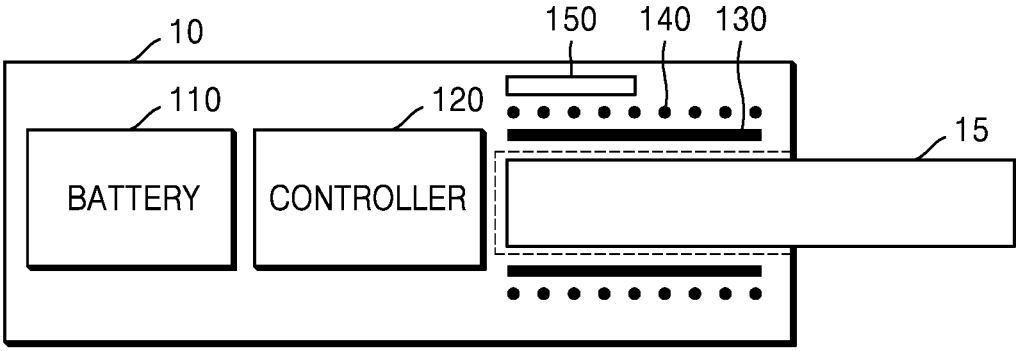
FIG. 1 is a view of an aerosol generation system according to some embodiments.

As a technical means for achieving one or more solutions to the above-described technical problem, one or more embodiments of the present disclosure may be provided.

According to one or more embodiments, an aerosol generating device may be provided. The aerosol generating device may include: a battery; a first control circuit configured to convert power received from the battery into a pulse width modulation (PWM) signal; a heater configured to heat an aerosol generating article based on the PWM signal received from the first control circuit; and a second control circuit configured to transmit an instruction to the first control circuit, for causing the first control circuit to generate the PWM signal in response to a user input to the first control circuit, wherein, based on a determination that the second control circuit is operating abnormally, the first control circuit is configured to block the PWM signal from being transmitted to the heater.

According to an embodiment, the first control circuit is configured to determine whether the second control circuit is operating abnormally based on at least one parameter generated from the second control circuit.

According to an embodiment, the first control circuit is configured to: compare the at least one parameter generated from the second control circuit with at least one parameter generated from the first control circuit, and determine that the second control circuit is operating normally based on the at least one parameter generated from the second control circuit and the at least one parameter generated from the first control circuit matching each other.

According to an embodiment, the first control circuit is configured to: determine that the second control circuit is operating abnormally based on the at least one parameter generated from the second control circuit and the at least one parameter generated from the first control circuit not matching each other.

According to an embodiment, the first control circuit is configured to: determine that the second control circuit is operating abnormally when the first control circuit fails to receive the at least one parameter generated from the second control circuit within a preset time.

According to an embodiment, the at least one parameter generated from the second control circuit and the at least one parameter generated from the first control circuit include a current temperature value of the heater, a target value of a temperature to be controlled by the first control circuit, an operation duration of the heater, and a count accumulating a number of times the second control circuit and the first control circuit communicate with each other.

According to an embodiment, the first control circuit comprises a timer for measuring an operation duration of the heater, and the first control circuit is further configured to, when determined that the second control circuit is operating abnormally, block the PWM signal from being transmitted to the heater based on the operation duration measured by the timer exceeding a threshold value.

According to one or more embodiments, an aerosol generating device is provided. The aerosol generating device may include: a battery; a first control circuit configured to convert power received from the battery into a pulse width modulation (PWM) signal; a heater configured to heat an aerosol generating article based on the PWM signal received from the first control circuit; and a second control circuit configured to transmit an instruction for causing the first control circuit to generate the PWM signal in response to a user input to the first control circuit, wherein the first control circuit is configured to determine whether the second control circuit is operating abnormally based on a parameter generated from the second control circuit, and the second control circuit is configured to determine whether the aerosol generating device is operating abnormally based on at least one from among a parameter generated from the first control circuit, the parameter generated from the second control circuit, and a parameter indicating whether power is supplied to at least one from among the first control circuit and the second control circuit.

According to an embodiment, the second control circuit is configured to determine that a communication error between the second control circuit and the first control circuit has occurred based on the parameter generated from the first control circuit corresponding to a negative acknowledgment (NACK) signal.

According to an embodiment, the second control circuit is configured to reset the first control circuit based on determining that the first control circuit is operating abnormally.

According to an embodiment, the aerosol generating device further includes a display capable of outputting visual information, wherein the second control circuit is configured to, based on determining the aerosol generating device is operating abnormally, output a notification using the display indicating a state corresponding to abnormal operation of the aerosol generating device.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like.

In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that, although the terms first, second, etc. may be used herein to describe various elements, these elements should not be limited by these terms. These terms are used to distinguish one element from another.

Hereinafter, example embodiments of the present disclosure will now be described more fully with reference to the accompanying drawings, such that one of ordinary skill in the art may easily work the present disclosure. Embodiments of the present disclosure may, however, be embodied in many different forms and should not be construed as being limited to the embodiments set forth herein.

FIG. 1 is a view of an aerosol generation system according to some embodiments.

Referring to FIG. 1, the aerosol generating system may include an aerosol generating device 10 and a cigarette 15. The aerosol generating device 10 may include an accommodation space into which the cigarette 15 is inserted, and may generate an aerosol by heating the cigarette 15 inserted into the accommodation space. The cigarette 15 is a kind of aerosol generating article, and may include an aerosol generating material. Meanwhile, in FIG. 1, for convenience of explanation, the aerosol generating device 10 is shown to be used together with the cigarette 15, but this is only an example. The aerosol generating device 10 may be used with any suitable aerosol generating article, even if it is not a cigarette 15.

The aerosol generating device 10 may include a battery 110, a controller 120, a susceptor 130, an induction coil 140, and a cigarette insertion detection sensor 150. However, an internal structure of the aerosol generating device 10 is not limited to that shown in FIG. 1. Depending on the design of the aerosol generating device 10, it is to be understood by one of ordinary skilled in the art that some of the hardware configurations shown in FIG. 1 may be omitted or a new configuration may be added.

The battery 110 may supply power to be used for the aerosol generating device 10 to operate. For example, the battery 110 may supply power so that the induction coil 140 may generate a variable magnetic field. In addition, the battery 110 may supply power required for operations of other hardware components provided in the aerosol generating device 10, for example, various sensors (not shown), a user interface (not shown), a memory (not shown), and the controller 120. The battery 110 may be a rechargeable battery or a disposable battery. For example, the battery 110 may be a lithium polymer (LiPoly) battery, but is not limited thereto.

The controller 120 is hardware that controls the overall operation of the aerosol generating device 10. For example, the controller 120 controls operations of not only the battery 110, the susceptor 130, the induction coil 140, and the cigarette insertion detection sensor 150, but also other components included in the aerosol generating device 10. In addition, the controller 120 may determine whether the aerosol generating device 10 is in an operable state by checking the states of each of the components of the aerosol generating device 10.

The controller 120 may include a main control circuit that controls all the components included in the aerosol generating device 10, and may further include a heater control circuit that intensively controls only a heater composed of the susceptor 130 and the induction coil 140.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The susceptor 130 may include a material that is heated when a variable magnetic field is applied. For example, the susceptor 130 may include a metal or carbon. The susceptor 130 may include at least one of ferrite, a ferromagnetic alloy, stainless steel, and aluminum (Al). In addition, the susceptor 130 may include at least one of ceramics such as graphite, molybdenum, silicon carbide, niobium, a nickel alloy, a metal film, zirconia, etc., a transition metal such as nickel (Ni) or cobalt (Co), and a metalloid such as boron (B) or phosphorus (P). However, embodiments of the present disclosure are not limited thereto.

In an example, the susceptor 130 may be tubular or cylindrical, and may be arranged to surround the accommodation space into which the cigarette 15 is inserted. When the cigarette 15 is inserted into the accommodation space of the aerosol generating device 10, the susceptor 130 may be arranged to surround the cigarette 15. Therefore, the temperature of an aerosol-generating material in the cigarette 15 may be increased by heat transmitted from the susceptor 130 that is external.

The induction coil 140 may generate a variable magnetic field as power is supplied from the battery 110. The variable magnetic field generated by the induction coil 140 may be applied to the susceptor 130, and accordingly, the susceptor 130 may be heated. Power supplied to the induction coil 140 may be adjusted under the control of the controller 120, and a temperature at which the susceptor 130 is heated may be properly maintained.

The cigarette insertion detection sensor 150 may detect whether the cigarette 15 is inserted into the accommodation space of the aerosol generating device 10. In an example, the cigarette 15 may include a metal material such as aluminum, and the cigarette insertion detection sensor 150 may be an inductive sensor that detects a change in a magnetic field generated as the cigarette 15 is inserted into the accommodation space. However, embodiments of the present disclosure are not necessarily limited thereto. The cigarette insertion detection sensor 150 may be an optical sensor, a temperature sensor, or a resistance sensor.

Based on detecting the insertion of the cigarette, the controller 120 may automatically perform a heating operation without additional external input. For example, the controller 120 may control the battery 110 to supply power to the induction coil 140 when detecting that the cigarette 15 has been inserted by using the cigarette insertion detection sensor 150. As a variable magnetic field is generated by the induction coil 140, the susceptor 130 may be heated. Accordingly, the cigarette 15 arranged inside the susceptor 130 may be heated, and an aerosol may be generated.

Meanwhile, the aerosol generating device 10 may further include general-purpose components in addition to the battery 110, the controller 120, the susceptor 130, the induction coil 140, and the cigarette insertion detection sensor 150. For example, the aerosol generating device 10 may further include other sensors (e.g., a temperature sensor, a puff sensor, etc.), a user interface, and a memory in addition to the cigarette insertion sensor 150.

The user interface may provide information about a state of the aerosol generating device 10 to a user. The user interface may include a display or lamp that outputs visual information, a motor that outputs tactile information, a speaker that outputs sound information, and input/output (I/O) interfacing devices for receiving information input from a user or outputting information to a user (e.g., a button or a touch screen). In addition, the user interface may include various interfacing devices such as terminals for performing data communication or receiving charging power, and a communication interfacing module for performing wireless communication (e.g., WI-FI, WI-FI Direct, Bluetooth, Bluetooth Low Energy (BLE), Near-Field Communication (NFC), etc.) with an external device.

In the aerosol generating device 10 according to some embodiments of the present disclosure, only some of examples of various user interfaces described above may be selected and implemented. In addition, the aerosol generating device 10 may be implemented by combining at least some of the examples of various user interfaces described above. For example, the aerosol generating device 10 may include a touch screen display capable of receiving a user input while outputting visual information on the front side. The touch screen display may include a fingerprint sensor, and user authentication may be performed by the fingerprint sensor.

The memory is hardware that stores various types of data processed in the aerosol generating device 10, and the memory may store data processed by the controller 120 and data to be processed. The memory may be implemented in various types, such as random access memory (RAM) (e.g. dynamic RAM (DRAM), static RAM (SRAM), etc.), read-only memory (ROM), and electrically erasable programmable ROM (EEPROM). The memory may store an operation time of the aerosol generating device 10, a maximum number of puffs, a current number of puffs, at least one temperature profile, and data about a user's smoking pattern.

Figure 2:
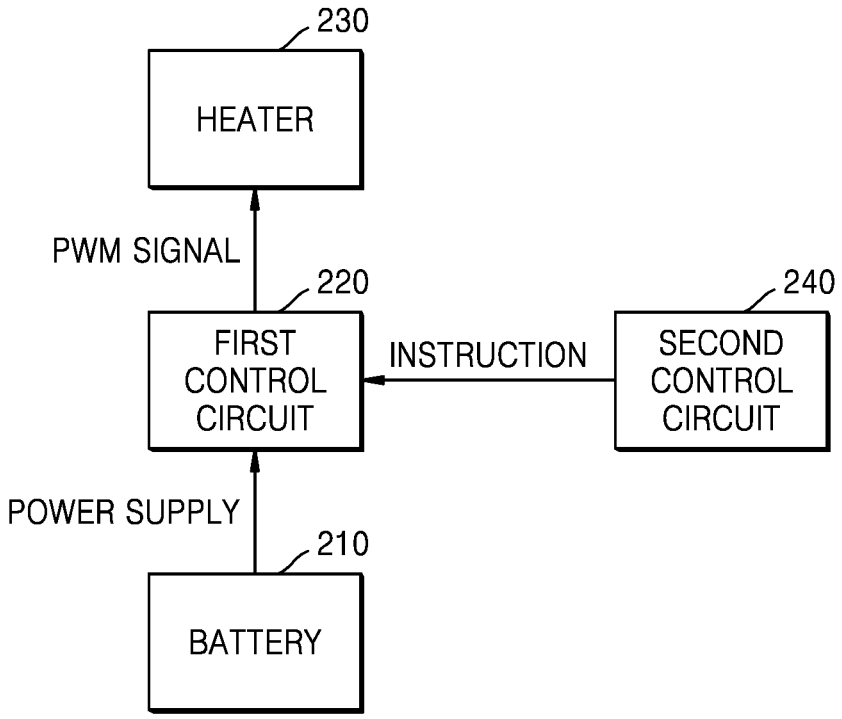
FIG. 2 is a block diagram illustrating a driving method of an aerosol generating device according to some embodiments.

FIG. 2 is a block diagram illustrating a driving method of an aerosol generating device according to some embodiments. The aerosol generating device may correspond to the aerosol generation device 10 of FIG. 1. For example, a battery 210 of FIG. 2 corresponds to the battery 110 of FIG. 1. Therefore, redundant descriptions will not be given herein.

Referring to FIG. 2, a first control circuit 220 may refer to hardware that controls the overall operation of a heater 230 (e.g., the susceptor 130 and the induction coil 140 of FIG. 1). The first control circuit 220 may be a microcontroller unit (MCU), and the first control circuit 220 may be implemented as hardware independent from a second control circuit 240.

The first control circuit 220 includes at least one processor. A processor can be implemented as an array of a plurality of logic gates or can be implemented as a combination of a general-purpose microprocessor and a memory in which a program executable in the microprocessor is stored. Further, the first control circuit 220 may be implemented as a system on chip. However, it will be understood by one of ordinary skill in the art that the first control circuit 220 may be implemented in other types of hardware.

The first control circuit 220 may control a heating operation of the heater 230. For example, the first control circuit 220 may control power supply from the battery 210 to the heater 230 in order to control at least one of a heating temperature and a heating time of the heater 230. The first control circuit 220 may control power supplied to the heater 230 so that the heating operation of the heater 230 starts or ends. In addition, the first control circuit 220 may control the amount of power supplied to the heater 230 and the time at which the power is supplied so that the heater 230 is heated to a certain temperature or maintains an appropriate temperature.

The first control circuit 220 may adjust the power supplied to the heater 230 using a pulse width modulation (PWM) control method, specifically, may change the power received from the battery into a PWM signal, and may transmit the PWM signal to the heater 230 to adjust power supplied to the heater 230.

The heater 230 may refer to a hardware configuration for receiving the PWM signal from the first control circuit 220, and heating a cigarette inserted in an accommodation space of the aerosol generating device based on the received PWM signal. The heater 230 may heat the cigarette using an induction heating method. For example, the heater 230 may include an induction coil for generating a variable magnetic field and a susceptor heated by the variable magnetic field. Because the induction coil and the susceptor included in the heater 230 correspond to the susceptor 130 and the induction coil 140 of FIG. 1, respectively, redundant descriptions will not be given herein.

Figure 3:
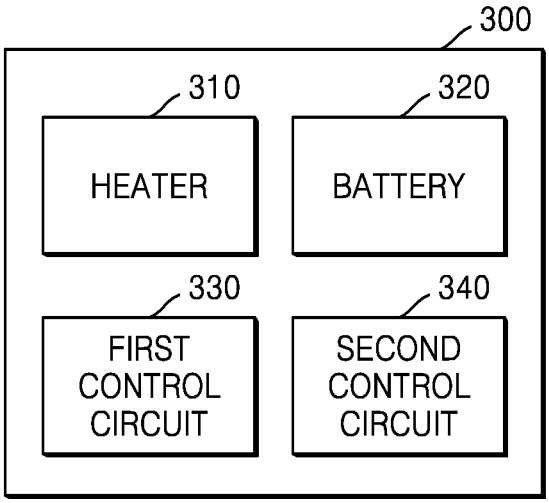
FIG. 3 is a block diagram of a configuration of an aerosol generating device according to some embodiments.

The second control circuit 240 may refer to hardware that controls the overall operation of the aerosol generating device. The second control circuit 240 may be an MCU, but is not limited thereto. The second control circuit 240 may transmit an instruction for causing the first control circuit 220 to generate a PWM signal in response to a user input, and the instruction for generating the PWM signal may be a signal for the second control circuit 240 to drive the first control circuit 220. FIG. 3 is a block diagram of a configuration of an aerosol generating device according to some embodiments.

Referring to FIG. 3, an aerosol generating device 300 may include a heater 310, a battery 320, a first control circuit 330, and a second control circuit 340. In the aerosol generating device 300 shown in FIG. 3, components related to the present embodiment are shown. However, it is to be understood by one of ordinary skill in the art that other general-purpose components may be further included in the aerosol generating device 300 in addition to the components shown in FIG. 2. Meanwhile, the heater 310 of FIG. 3 corresponds to the heater 230 of FIG. 2, the battery 320 of FIG. 3 corresponds to the battery 110 of FIG. 1 and the battery 210 of FIG. 2, the first control circuit 330 of FIG. 3 corresponds to the first control circuit 220 of FIG. 2, and the second control circuit 340 of FIG. 3 corresponds to the second control circuit 240 of FIG. 2. Therefore, redundant descriptions will not be given herein.

The first control circuit 330 may communicate with the second control circuit 340. For example, the first control circuit 330 may transmit a parameter generated from the first control circuit 330 to the second control circuit 340 and may receive a parameter generated from the second control circuit 340. Hereinafter, a process in which the first control circuit 330 and the second control circuit 340 exchange parameters through communication will be described in detail with reference to FIG. 4.

Figure 4:
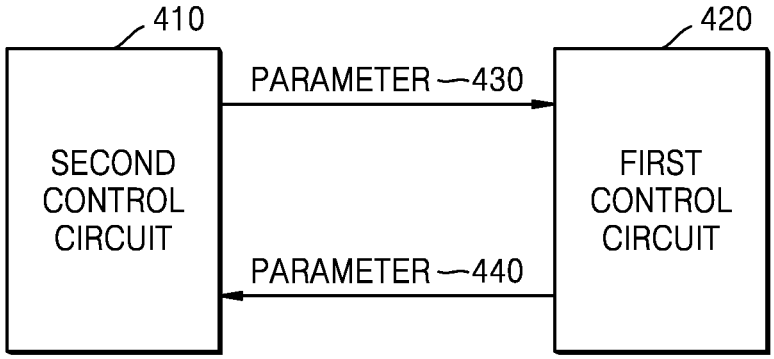
FIG. 4 is a schematic view illustrating an operating method of an aerosol generating device according to some embodiments.

FIG. 4 is a schematic view illustrating an operating method of an aerosol generating device according to some embodiments.

FIG. 4 illustrates a process in which a second control circuit 410 and a first control circuit 420 exchange parameters through communication. Because the first control circuit 420 of FIG. 4 corresponds to the first control circuit 220 of FIG. 2 and the first control circuit 330 of FIG. 3, and the second control circuit 410 of FIG. 4 corresponds to the second control circuit 240 of FIG. 2 and the second control circuit 340 of FIG. 3, redundant descriptions will not be given herein.

The second control circuit 410 may generate a parameter 430 and transmit the parameter 430 to the first control circuit 420. The parameter 430 refers to a data value generated from the second control circuit 410, and may be used to control components included in an aerosol generating device. For example, the second control circuit 410 may transmit the generated parameter 430 to the first control circuit 420 to control the first control circuit 420 to adjust an operating time of the heater.

The parameter 430 may include, but is not limited to, a current temperature value of the heater, a target value of the temperature of a heating part of the heater to be controlled by the first control circuit 420, duration of a heating operation of the heater, a count for accumulating the number of times the second control circuit 410 and the first control circuit 420 communicate with each other, a value indicating whether the second control circuit 410 receives a parameter (e.g. parameter 440), and the like. For example, the parameter 430 may include an instruction for generating a PWM signal described with reference to FIG. 2.

The first control circuit 420 may receive the parameter 430 generated from the second control circuit 410 and perform an operation corresponding to the parameter 430 that is received. In addition, the second control circuit 420 may generate a parameter 440 and transmit the parameter 440 to the second control circuit 410. The parameter 440 may be generated in response to the reception of the parameter 430 or may be generated separately from the reception of the parameter 430. For example, the parameter 440 may include, but is not limited to, a value indicating whether the first control circuit 420 receives a parameter (e.g., parameter 430), a current temperature value of the heater, a target value of the temperature of the heating part to be controlled by the first control circuit 420, duration of a heating operation of the heater, a count for accumulating the number of times the second control circuit 410 and the first control circuit 420 communicate with each other, and the like.

Meanwhile, the second control circuit 410 and the first control circuit 420 may communicate with each other using various methods. For example, a method of communicating between the second control circuit 410 and the first control circuit 420 may be serial communication. The second control circuit 410 and the first control circuit 420 may exchange the parameter 430 and the parameter 440 using serial communication such as an inter-integrated circuit (I2C), a universal asynchronous receiver transmitter (UART), and a serial peripheral interface (SPI), but embodiments of the present disclosure are not limited thereto.

Returning to FIG. 3, the first control circuit 330 may determine whether the second control circuit 340 is operating abnormally based on the parameter generated from the second control circuit 340.

In an embodiment, the first control circuit 330 compares the parameter generated from the second control circuit 340 with the parameter generated from the first control circuit 330, and when the parameter generated from the second control circuit 340 and the parameter generated from the first control circuit 330 match each other, may determine that the second control circuit 340 operates normally. However, when the parameter generated from the second control circuit 340 and the parameter generated from the first control circuit 330 do not match each other, the first control circuit 330 may determine that the second control circuit 340 is operating abnormally.

For example, when the second control circuit 340 generates a parameter indicating that a heating operation is performed for 15 seconds, but the first control circuit 330 generates a parameter indicating that a heating operation is performed for 10 seconds, this may correspond to a case in which one of the second control circuit 340 and the first control circuit 330 is operating abnormally. As described above, in a situation where it is unclear which of the second control circuit 340 and the first control circuit 330 is operating abnormally, it may be safer for the first control circuit 330 to terminate a heating operation by determining abnormal operation of the second control circuit 340 rather than continuing the heating operation according to the parameter generated from the second control circuit 340. Accordingly, the first control circuit 330 may determine that the second control circuit 340 is operating abnormally.

In addition, in another embodiment, when not receiving the parameter generated from the second control circuit 340 within a preset time, the first control circuit 330 may determine that the second control circuit 340 is operating abnormally. For example, the first control circuit 330 may determine that the second control circuit 340 is operating abnormally when not receiving a control command from the second control circuit 340 to terminate a heating operation of the heater 310 within a preset time after receiving a control command to start the heating operation of the heater 310 from the second control circuit 340 and while performing the heating operation.

On the other hand, "matching" may mean a case where two arbitrary parameters are identical and coincide, or may mean a case where two arbitrary parameters do not have a same name but a value corresponding to one parameter is a value of another parameter, but is not limited thereto.

When it is determined that the second control circuit 340 is operating abnormally, the first control circuit 330 may stop the heating operation of the heater 310 by blocking a PWM signal transmitted from the first control circuit 330 to the heater 310. Accordingly, an overheating state due to an abnormal heating operation of the aerosol generating device may be prevented. The PWM signal blocking may mean a case where the first control circuit 330 does not generate the PWM signal, or a case where the first control circuit 330 generates the PWM signal but does not transmit the PWM signal, but is not limited thereto.

In an embodiment, the first control circuit 330 may include a timer. The timer may measure duration of the heating operation of the heater 310, and when it is determined that the second control circuit 340 is operating abnormally, may block the PWM signal transmitted from the first control circuit 330 to the heater 310 based on the duration of the heating operation of the heater 310 measured by the timer exceeding a threshold value. For example, the threshold value may be 1 second, 5 seconds, 10 seconds, 15 seconds, 20 seconds, etc., but is not limited thereto.

In addition to a problem that abnormal heating occurs due to a continuous heating operation of the heater 310, other problems may occur in the components included in the aerosol generating device 300, and the first control circuit 330 may prevent these problems. In an embodiment, the first control circuit 330 may include a switch. The switch may be associated with a signal that controls the power of the aerosol generating device 300, and when it is determined that the second control circuit 340 is operating abnormally, the first control circuit 330 may close the switch to cut off all power supply from the battery 320 to the components included in the aerosol generating device 300.

As described above, the aerosol generating device 300 according to embodiments of the present disclosure includes the first control circuit 330, so that even if an error occurs in the second control circuit 340, stability of the aerosol generating device 300 may be guaranteed.

The second control circuit 340 may determine abnormal operation of the aerosol generating device 300 based on at least one parameter among the parameter generated from the first control circuit 330, a parameter generated from the second control circuit 340, and a parameter indicating whether power is supplied to at least one of the second control circuit 340 and the first control circuit 330.

In an embodiment, the second control circuit 340 compares the parameter generated from the first control circuit 330 with the parameter generated from the second control circuit 340, and when the parameter generated from the first control circuit 330 and the parameter generated from the second control circuit 340 match each other, may determine that the first control circuit 330 operates normally. However, when the parameter generated from the first control circuit 330 and the parameter generated from the second control circuit 340 do not match each other, the second control circuit 340 may determine that the first control circuit 330 is operating abnormally.

For example, when the second control circuit 340 transmits a parameter indicating that a heating operation is performed for 10 seconds to the first control circuit 330, if the first control circuit 330 operates normally, the first control circuit 330 may generate a parameter indicating that the heating operation is performed for 10 seconds in response to the parameter reception from the second control circuit 340 and control the heater 310 based on the generated parameter. However, when a parameter indicating that the heating operation is performed for 20 seconds instead of the parameter indicating that the heating operation is performed for 10 seconds is generated from the first control circuit 330, this may correspond to a case where the first control circuit 330 is operating abnormally, and thus, the second control circuit 340 may determine that the first control circuit 330 is operating abnormally based on whether the parameters match.

When it is determined that the first control circuit 330 is operating abnormally, the second control circuit 340 may initialize the parameter generated from the first control circuit 330 by resetting the first control circuit 330. Accordingly, an abnormal heating operation of the heater by the control of the first control circuit 330 may be prevented.

In addition, when abnormal operation of the aerosol generating device 300 is determined, the second control circuit 340 may output a notification indicating a state corresponding to the abnormal operation. For example, when abnormal operation of the first control circuit 330 is determined, the second control circuit 340 may output a notification indicating the abnormal operation of the first control circuit 330. Accordingly, a user may more easily recognize a state corresponding to the abnormal operation of the aerosol generating device 300. Meanwhile, the notification may be provided to a user through a touch screen display provided in the aerosol generating device 300, but is not limited thereto.

In this way, the second control circuit 340 may increase stability of the aerosol generating device 300 by determining abnormal operations of the components included in the aerosol generating device 300 and performing a corresponding action.

Figure 5:
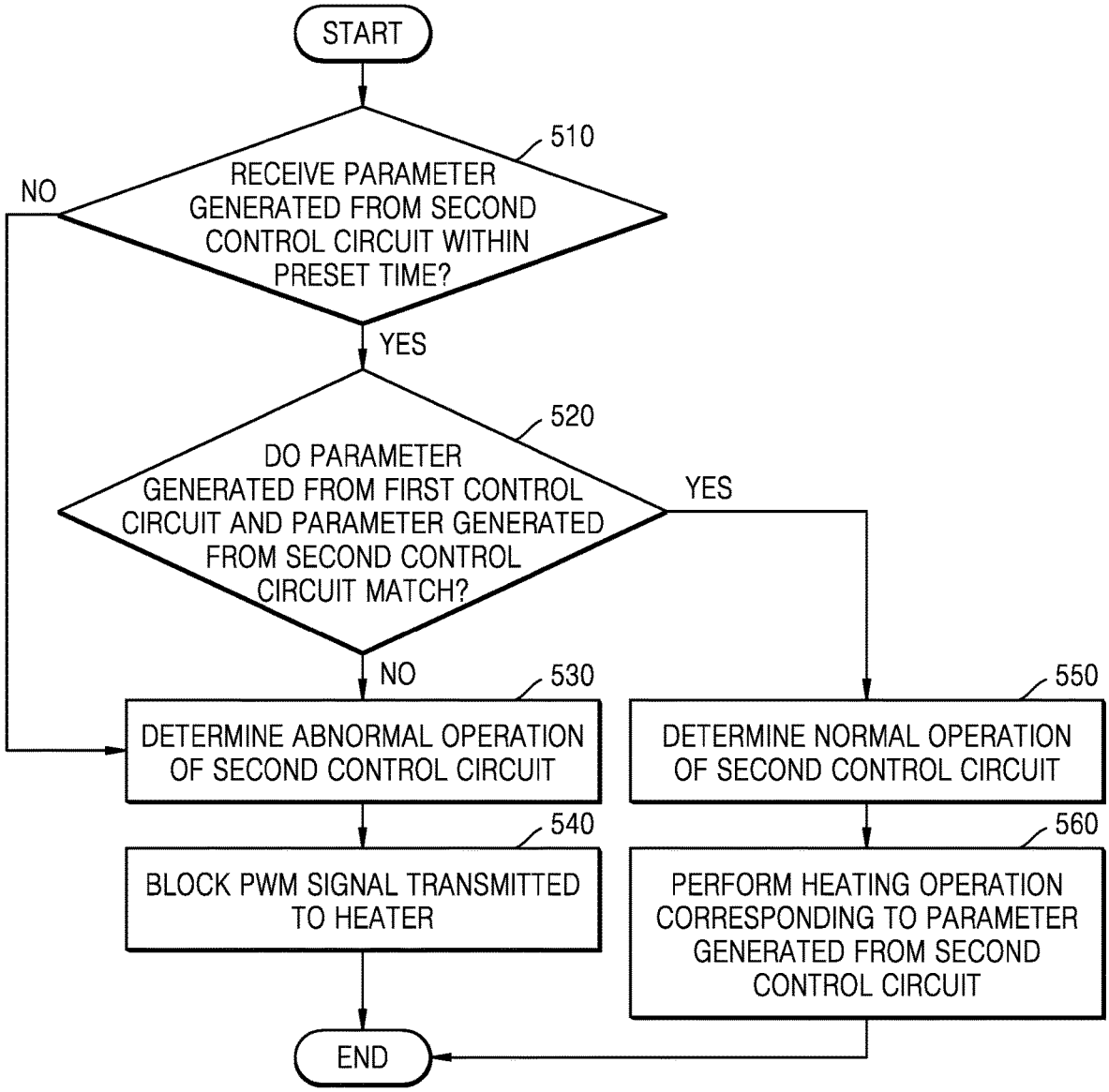
FIG. 5 is a flowchart illustrating an operating method of a first control circuit according to some embodiments.

FIG. 5 is a flowchart illustrating an operating method of a first control circuit according to some embodiments. The operating method of FIG. 5 may be performed by an aerosol generating device. For example, the operating method of FIG. 5 may be performed by a first control circuit included in the aerosol generating device. Because the first control circuit corresponds to the first control circuit 220 of FIG. 2, the first control circuit 330 of FIG. 3, and the first control circuit 420 of FIG. 4, redundant descriptions will not be given herein.

Referring to FIG. 5, in operation 510, the first control circuit may determine whether a parameter generated from a second control circuit is received within a preset time.

After transmitting a parameter generated from the first control circuit to the second control circuit, the first control circuit may perform operation 520 based on receiving a parameter generated from the second control circuit within the preset time, or may perform operation 530 based on not receiving the parameter generated from the second control circuit within the preset time.

In operation 530, the first control circuit may determine abnormal operation of the second control circuit. When it is determined that the second control circuit is operating abnormally, the first control circuit may perform operation 540.

In operation 540, the first control circuit may block a PWM signal transmitted to a heater.

In an embodiment, the first control circuit may include a timer. The timer may measure duration of a heating operation of the heater, and when it is determined that the second control circuit is operating abnormally, may block the PWM signal transmitted from the first control circuit to the heater based on the duration of the heating operation of the heater measured by the timer exceeding a threshold value.

In operation 520, the first control circuit may determine whether the parameter generated from the first control circuit and the parameter generated from the second control circuit match. The first control circuit may perform operation 550 when the generated parameters match, and may perform operation 530 when the generated parameters do not match.

In operation 530, the first control circuit may determine that the abnormal operation of the second control circuit. Meanwhile, in operation 5540, when it is determined that the second control circuit is operating abnormally, the first control circuit may block the PWM signal transmitted from the first control circuit to the heater.

In operation 550, when the parameter generated from the first control circuit and the parameter generated from the second control circuit match, the first control circuit may determine a normal operation of the second control circuit.

In operation 560, when it is determined that the second control circuit operates normally, the first control circuit may perform a heating operation corresponding to the parameter generated from the second control circuit.

For example, when it is determined that the second control circuit operates normally, the first control circuit may continue the heating operation of the heater or may stop the heating operation after continuing the heating operation for a certain time, but is not limited thereto.

Figure 6:
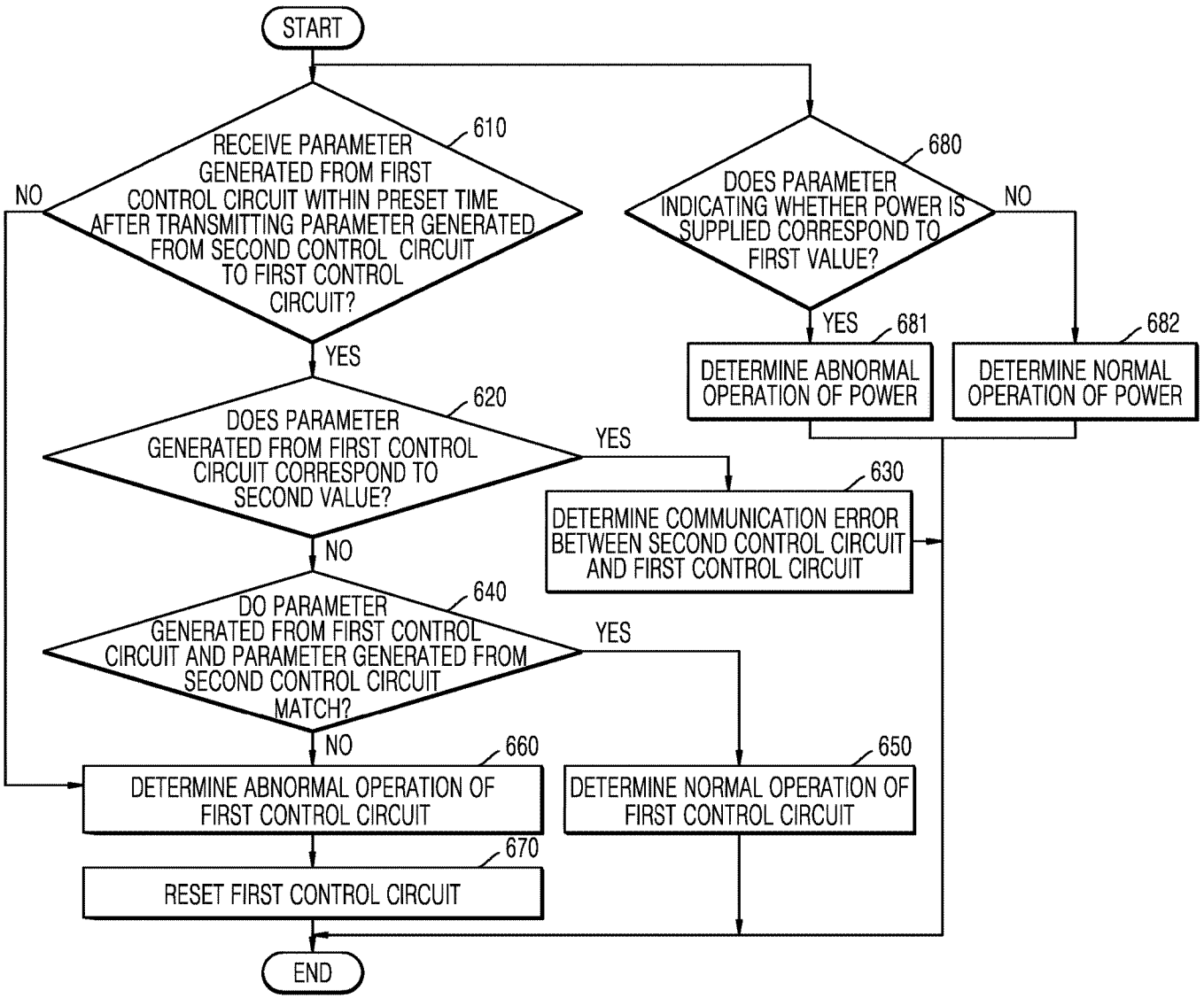
FIG. 6 is a flowchart illustrating an operating method of a second control circuit according to some embodiments.

FIG. 6 is a flowchart illustrating an operating method of a second control circuit according to some embodiments. The operating method of FIG. 6 may be performed by an aerosol generating device. For example, the operating method of FIG. 6 may be performed by a second control circuit included in the aerosol generating device. Because the second control circuit corresponds to the second control circuit 240 of FIG. 2, the second control circuit 340 of FIG. 3, and the second control circuit 410 of FIG. 4, redundant descriptions will not be given herein.

In operation 610, after transmitting a parameter generated from the second control circuit to a first control circuit, the second control circuit may determine whether a parameter generated from the first control circuit has been received within a preset time.

The second control circuit may perform operation 620 based on receiving the parameter generated from the first control circuit within the preset time, and may perform operation 660 based on not receiving the parameter.

In operation 660, the second control circuit may determine abnormal operation of the first control circuit. When it is determined that the first control circuit is operating abnormally, the second control circuit may perform operation 670.

In operation 670, the second control circuit may reset the first control circuit. For example, when it is determined that the first control circuit is operating abnormally, the second control circuit may cut off power supply from a battery to the first control circuit for a certain time and then supply power again.

In operation 620, the second control circuit may determine whether the parameter generated from the first control circuit corresponds to a second value.

The second value may mean a parameter related to whether the first control circuit receives the parameter generated from the second control circuit.

In an embodiment, the second control circuit and the first control circuit may perform serial communication, and when they are performing I2C communication, the second value may be a negative acknowledge (NACK) signal, but is not limited thereto.

When the parameter generated from the first control circuit corresponds to the second value, operation 630 may be performed, and when the parameter does not correspond to the second value, operation 640 may be performed.

In operation 630, the second control circuit may determine a communication error between the second control circuit and the first control circuit has occurred. The communication error may mean a state in which communication is impossible at all because the second control circuit and the first control circuit are not connected to each other, a state in which communication is possible, but there is a problem in a connection line for communication between the second control circuit and the first control circuit, so accurate communication is not possible, and a state in which accurate communication is impossible due to the abnormal operation of the first control circuit, but is not limited thereto.

In operation 640, the second control circuit may determine whether the parameter generated from the first control circuit and the parameter generated from the second control circuit match. Operation 650 may be performed when the parameters match, and operation 660 may be performed when parameters do not match.

In operation 650, the second control circuit may determine a normal operation of the first control circuit. When the parameter generated from the first control circuit and the parameter generated from the second control circuit match, the second control circuit may determine the first control circuit is operating normally.

In operation 660, the second control circuit may determine the abnormal operation of the first control circuit, and when it is determined that the first control circuit is operating abnormally, in operation 670, the second control circuit may reset the first control circuit. Therefore, an accident such as a fire may be prevented, and an error phenomenon of the aerosol generating device may be more accurately determined.

In operation 680, the second control circuit may determine whether a parameter(s) indicating whether power is supplied corresponds to a first value. The parameter(s) indicating whether power is supplied may include a parameter indicating whether power is supplied to the second control circuit and a parameter indicating whether power is supplied to the first control circuit. The second control circuit may perform operation 681 when the parameter(s) indicating whether power is supplied corresponds to the first value, and may perform operation 682 when the parameter(s) indicating whether power is supplied does not correspond to the first value.

In an embodiment, the parameter indicating whether power is supplied may be a signal by general-purpose input/output (GPIO), and the first value may be a value indicating power off, but are not limited thereto.

In operation 682, the second control circuit may determine a normal operation of the power. For example, when the parameter indicating whether power is supplied does not correspond to the value indicating power off, the second control circuit may determine that the power of the first control circuit operates normally.

In operation 681, the second control circuit may determine abnormal operation of the power. The abnormal operation of the power may mean that the power is not turned on due to a current leakage of the power.

One embodiment may also be implemented in the form of a computer-readable medium including instructions executable by a computer, such as a program module executable by the computer. The computer-readable medium may be any available medium that can be accessed by a computer and includes both volatile and nonvolatile media, and removable and non-removable media. In addition, the non-transitory computer readable medium may include all computer storing media and communication media. The computer storing medium may include any medium, such as, a volatile and non-volatile medium and a discrete type and non-discrete type medium that is realized by a method or technology for storing information, such as, a computer readable instruction, a data structure, a program module, or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made.

The invention claimed is:

1. An aerosol generating device comprising:

a battery;

a first control circuit configured to convert power received from the battery into a pulse width modulation (PWM) signal;

a heater configured to heat an aerosol generating article based on the PWM signal received from the first control circuit; and a second control circuit configured to transmit an instruction to the first control circuit, for causing the first control circuit to generate the PWM signal in response to a user input to the first control circuit, wherein, based on a determination that the second control circuit is operating abnormally, the first control circuit is configured to block the PWM signal from being transmitted to the heater, and wherein the first control circuit is configured to determine whether the second control circuit is operating abnormally based on at least one parameter generated from the second control circuit.

2. The aerosol generating device of claim 1, wherein the first control circuit is configured to:

compare the at least one parameter generated from the second control circuit with at least one parameter generated from the first control circuit; and determine that the second control circuit is operating normally based on the at least one parameter generated from the second control circuit and the at least one parameter generated from the first control circuit matching each other.

3. The aerosol generating device of claim 2, wherein the first control circuit is configured to determine that the second control circuit is operating abnormally based on the at least one parameter generated from the second control circuit and the at least one parameter generated from the first control circuit not matching each other.

4. The aerosol generating device of claim 1, wherein the first control circuit is configured to determine that the second control circuit is operating abnormally when the first control circuit fails to receive the at least one parameter generated from the second control circuit within a preset time.

5. The aerosol generating device of claim 1, wherein the at least one parameter generated from the second control circuit and the at least one parameter generated from the first control circuit include a current temperature value of the heater, a target value of a temperature to be controlled by the first control circuit, an operation duration of the heater, and a count accumulating a number of times the second control circuit and the first control circuit communicate with each other.

6. The aerosol generating device of claim 1, wherein the first control circuit comprises a timer for measuring an operation duration of the heater, and the first control circuit is further configured to, when determined that the second control circuit is operating abnormally, block the PWM signal from being transmitted to the heater based on the operation duration measured by the timer exceeding a threshold value.

7. An aerosol generating device comprising:

a battery;

a first control circuit configured to convert power received from the battery into a pulse width modulation (PWM) signal;

a heater configured to heat an aerosol generating article based on the PWM signal received from the first control circuit; and a second control circuit configured to transmit an instruction for causing the first control circuit to generate the PWM signal in response to a user input to the first control circuit, wherein the first control circuit is configured to determine whether the second control circuit is operating abnormally based on a parameter generated from the second control circuit, and the second control circuit is configured to determine whether the aerosol generating device is operating abnormally based on at least one from among a parameter generated from the first control circuit, the parameter generated from the second control circuit, and a parameter indicating whether power is supplied to at least one from among the first control circuit and the second control circuit.

8. The aerosol generating device of claim 7, wherein the second control circuit is configured to determine that a communication error between the second control circuit and the first control circuit has occurred based on the parameter generated from the first control circuit corresponding to a negative acknowledgment (NACK) signal.

9. The aerosol generating device of claim 7, wherein the second control circuit is configured to reset the first control circuit based on determining that the first control circuit is operating abnormally.

10. The aerosol generating device of claim 7, further comprising a display capable of outputting visual information, wherein the second control circuit is configured to, based on determining the aerosol generating device is operating abnormally, output a notification using the display indicating a state corresponding to abnormal operation of the aerosol generating device.

* * * * *